US007622695B2

(12) United States Patent
DiPucchio et al.

(10) Patent No.: US 7,622,695 B2
(45) Date of Patent: Nov. 24, 2009

(54) MULTI-LAYERED CARRIER

(76) Inventors: Jay DiPucchio, P.O. Box 575, South Deerfield, MA (US) 01373; Thomas J. Luck, P.O. Box 575, South Deerfield, MA (US) 01373

( * ) Notice: Subject to any disclaimer, the term of this patent is extended or adjusted under 35 U.S.C. 154(b) by 656 days.

(21) Appl. No.: 11/163,919

(22) Filed: Nov. 3, 2005

(65) Prior Publication Data

US 2006/0091133 A1 May 4, 2006

Related U.S. Application Data

(60) Provisional application No. 60/624,766, filed on Nov. 4, 2004.

(51) Int. Cl.
*H05B 3/34* (2006.01)
*H01C 3/00* (2006.01)

(52) U.S. Cl. ..... 219/545; 219/528; 219/529; 219/544; 219/385; 219/386; 219/387; 219/399; 219/409; 219/410; 219/413; 219/620; 219/621; 338/208

(58) Field of Classification Search ..... 338/208; 219/528–9, 544–5, 385–7, 399, 409–10, 219/413, 620–1
See application file for complete search history.

(56) References Cited

U.S. PATENT DOCUMENTS 5,977,517 A 11/1999 Grosjean
6,121,585 A 9/2000 Dam
6,222,160 B1 * 4/2001 Remke et al. ..... 219/387
6,232,585 B1 5/2001 Clothier et al.
6,403,935 B2 6/2002 Kochman et al.
6,433,313 B1 8/2002 Owens et al.
6,483,087 B2 * 11/2002 Gardner et al. ..... 219/545
6,555,789 B2 4/2003 Owens et al.
6,555,799 B2 4/2003 Owens et al.
2001/0025846 A1 10/2001 Kochman et al.
2002/0092838 A1 7/2002 Bostic et al.
2002/0117495 A1 8/2002 Kochman et al.
2002/0175159 A1 11/2002 Owens et al.
2003/0106889 A1 6/2003 Owens et al.
2003/0189037 A1 10/2003 Kochman et al.

* cited by examiner

*Primary Examiner*—Shawntina Fuqua
(74) *Attorney, Agent, or Firm*—Deborah A. Basile; Karen K. Chadwell

(57) ABSTRACT

A multi-layered carrier comprising: a first layer; a jacket; a laminated fabric heater disposed between the first layer and the jacket, wherein the heater comprises a consolidated electrically conductive fabric layer, a plurality of bus bars, a first thermoplastic layer, and a second thermoplastic layer, wherein the first and second thermoplastic layers sandwich the consolidated electrically conductive fabric layer and the plurality of bus bars to form a fused single sheet; and a cavity formed from the assembly of the first layer, the jacket, and the heater; wherein the multi-layer carrier provides for the even distribution of heat throughout the cavity.

16 Claims, 5 Drawing Sheets

MULTI-LAYERED CARRIER

CROSS REFERENCE TO RELATED APPLICATIONS

This application claims the benefit of U.S. Provisional Application No. 60/624,766 filed on Nov. 4, 2004.

BACKGROUND OF THE INVENTION

1. Field of the Invention

This invention relates to a multi-layered carrier. More particularly, the invention relates to a multi-layered carrier capable of containing thermal heat and maintaining uniform temperatures in an efficient manner, wherein the multi-layered carrier is particularly beneficial in the food and beverage transportation industry.

2. Background of the Invention

Delivery of perishable items, such as food and beverage items, has grown in popularity as an increasing number of individuals rely on food delivery services for their meals. Unfortunately, a frequently encountered problem in the food transportation industry is the dilemma of maintaining the food and/or beverage at its proper serving temperature. That is, all too commonly, the food and/or beverage is sent out for delivery at its serving temperature, and by the time the item is received by the consumer, the item has cooled to sub par temperatures. Such cooling can allow the growth of food borne bacteria, causing illness, and oftentimes affects the freshness and/or the taste of the food and/or beverage item, and creates an inconvenience to the consumer.

Thermal bags for carrying food products have been in use for many years, and electrically heated thermal bags using resistance wires have been in use for pizza delivery, for example, in more recent years. However, issues of electrical safety and the longevity of thermostats, thermal fuses, and resistance wires in a flexible use, as well as hot spots in the surfaces of these thermal bags have limited their acceptance in the market place.

Therefore, what is needed in the art is a multi-layered carrier that can transport perishable items to a consumer while maintaining the proper serving temperature of the perishable delivery item such that the item is served to the consumer in its safest, freshest, most proper form. While not specifically directed at the food delivery market, the present invention overcomes this and other problems by providing a uniform heat throughout the walls of the carrier as well as a totally sealed electric heater. In addition, through its high level of insulation and heat reflection it is able to maintain temperatures of food products without requiring a high heat output from the heater.

SUMMARY OF THE INVENTION

The above-discussed and other drawbacks and deficiencies of the prior art are overcome or alleviated by a multi-layered carrier comprising a primary liner, a secondary liner, a heater, a reflector, an insulator, and a jacket. The heater generates heat and comprises a conductive fabric layer such that the heater is thin and flexible, thereby allowing the heater to be bent and otherwise contorted to fit its operating environment. Additionally, the heater produces uniform temperatures throughout the multi-layered carrier and has a high fatigue life. The reflector and the insulator serve to retain the heat in the multi-layered carrier thereby indefinitely maintaining the temperature of the multi-layered carrier. There are no carriers of the prior art having the same commercial application quality as the novel carrier disclosed herein.

DETAILED DESCRIPTION OF THE INVENTION

In general, disclosed herein is a multi-layered carrier capable of containing thermal heat in a uniform and efficient manner, wherein the multi-layered carrier is particularly useful in the food and beverage transportation business. The various layers forming the multi-layered carrier may be positioned relative to each other in a variety of ways, wherein the positioning depends on the amount of heat contained within the carrier and the melting points of the various layers.

An exemplary multi-layered carrier will be described with reference to the figures. However, the figures are for illustrative purposes only, and modifications and alterations as would be obvious to one of ordinary skill in the art are contemplated and incorporated herein.

Figure 1:
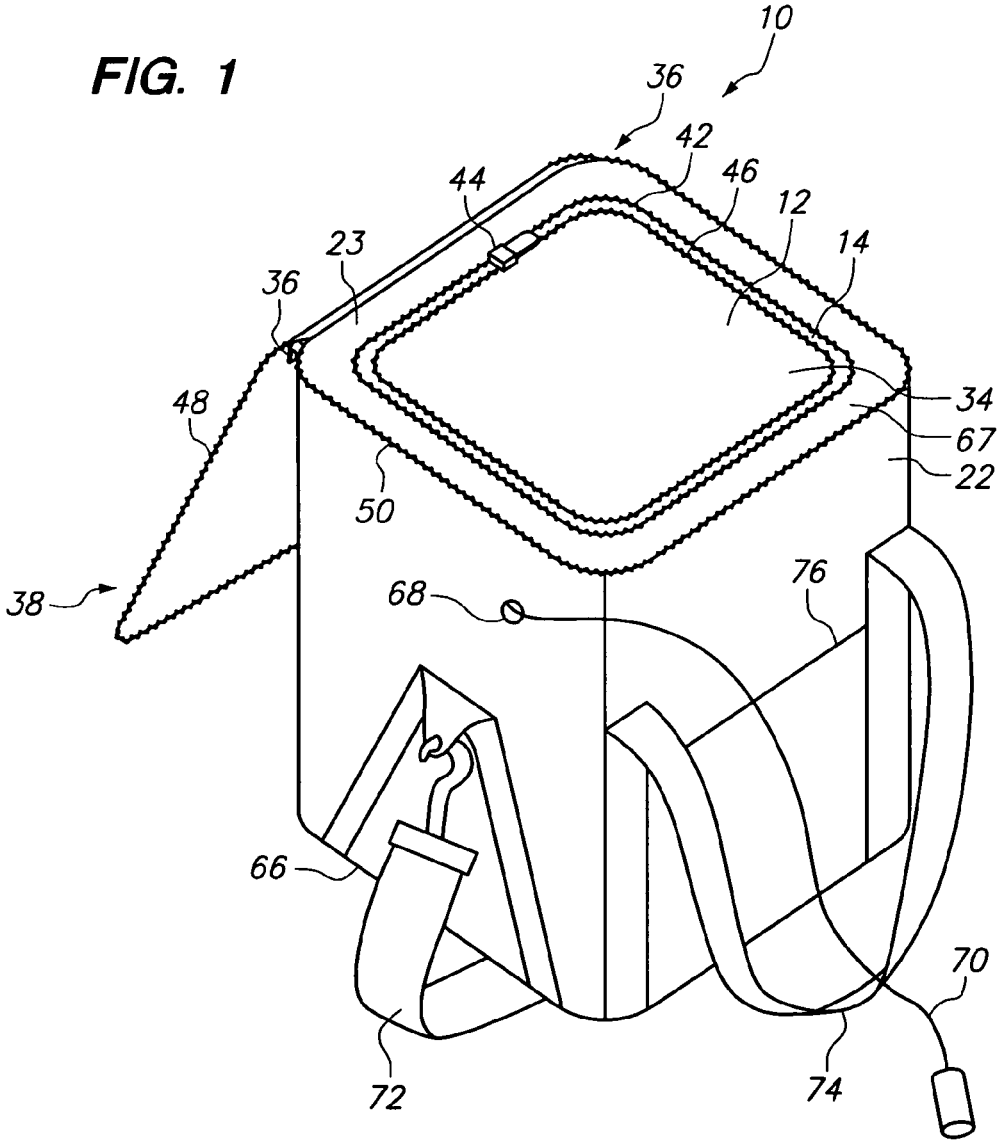
FIG. 1 is a schematic depicting a top elevational view of an exemplary multi-layered carrier.
Figure 2:
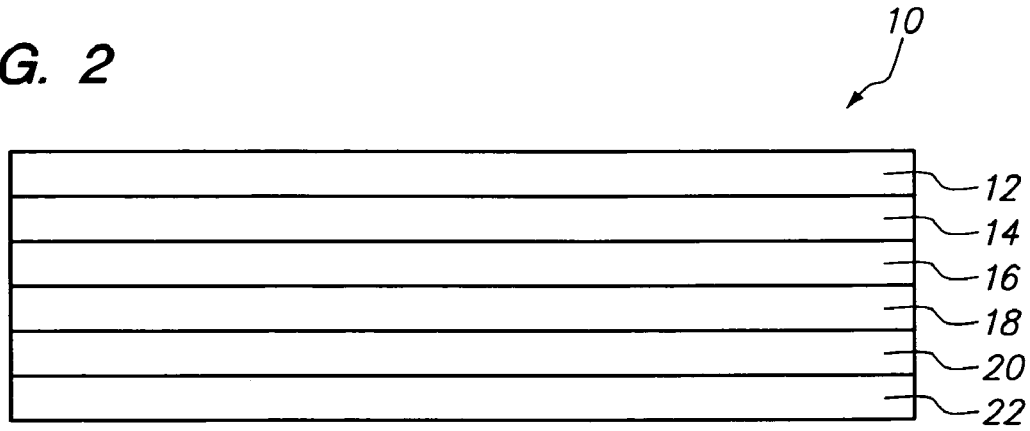
FIG. 2 is a schematic depicting a cross-sectional view of the multi-layered carrier depicted in FIG. 1.
Figure 3:
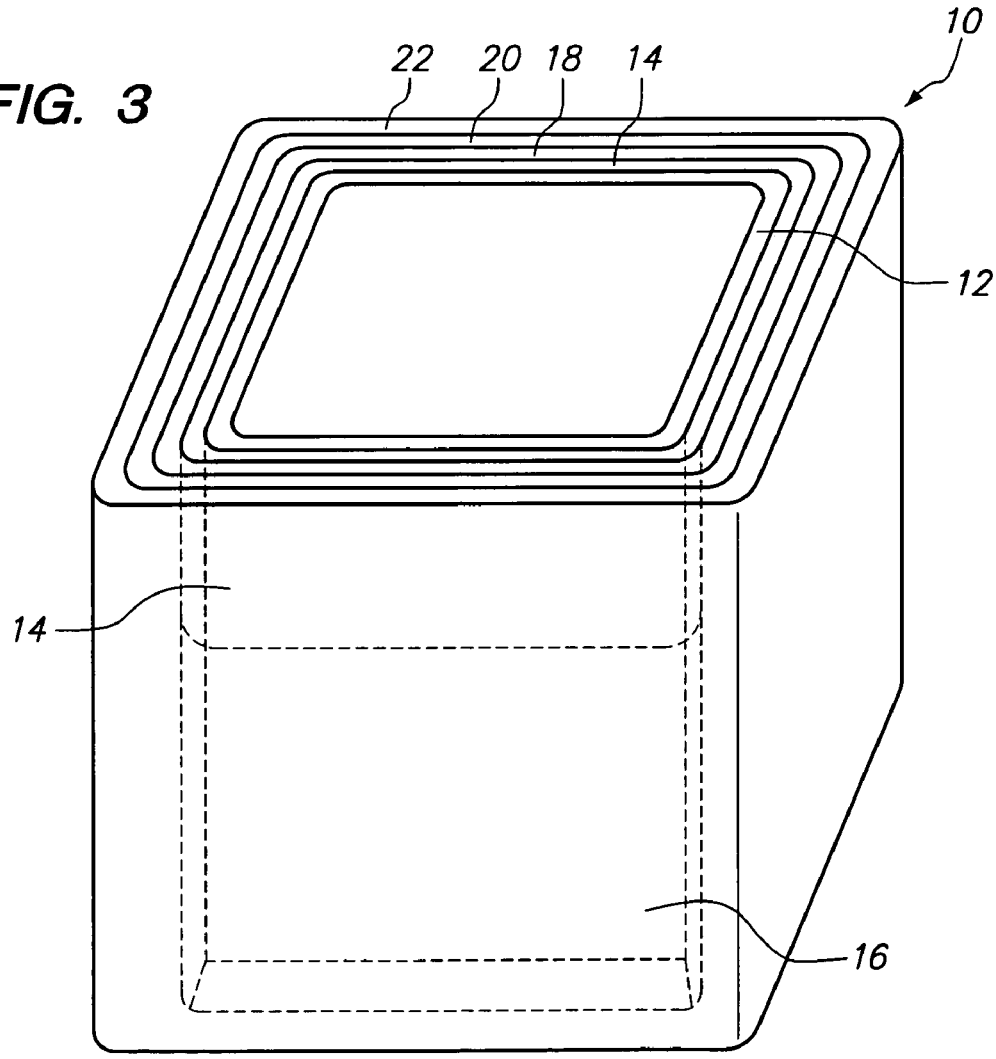
FIG. 3 is a schematic depicting a cross-sectional elevational view of the multi-layered carrier depicted in FIG. 1.

Referring to FIGS. 1-3, an exemplary multi-layered carrier 10 comprises a primary liner 12, a secondary liner 14, a heater 16, a reflector 18, an insulator 20, and a jacket 22. With the exception of jacket 22, which is preferably disposed on the lateral sides, a bottom side 66, and a top side 67 of carrier 10, the remaining layers are preferably disposed on at least one of any of the lateral sides, bottom side 66, and top side 67. All or some of the layers may additionally be disposed in a cover 38 of multi-layered carrier 10.

Primary liner 12 serves as the innermost layer of multi-layered carrier 10. Primary liner 12 may comprise a variety of materials, wherein vinyl is preferred as it is an easily cleaned material. In order to facilitate the cleaning of multi-layered carrier 12 resulting from, for example, food and/or beverage spillage, primary liner 12 may be removable. An exemplary fastening device for removably attaching primary liner 12 to multi-layered carrier 10 comprises an inner zipper, wherein both of primary liner 12 and secondary liner 14 comprise teeth 46 and 42 respectively to form the zipper. However, primary liner 12 may also be removably attached to multi-layered carrier 10 by a variety of fastening elements comprising buttons, hook and loop fastener tapes such as Velcro®, snaps, combinations of the foregoing, and the like. In these embodiments, the secondary liner, or other layer to which the primary liner is attached, has corresponding fastening means. Or, primary liner 12 may be disposed adjacent to the secondary liner or other layer without the use of fastening means, whereby primary liner 12 is fitted to the multi-layered carrier such that it does not shift or move when positioned. Alternatively, primary liner 12 may be permanently attached to multi-layered carrier 10 by, for example, stitching or sealing primary liner 12 onto at least one of the other layers forming multi-layered carrier 10.

Figure 4:
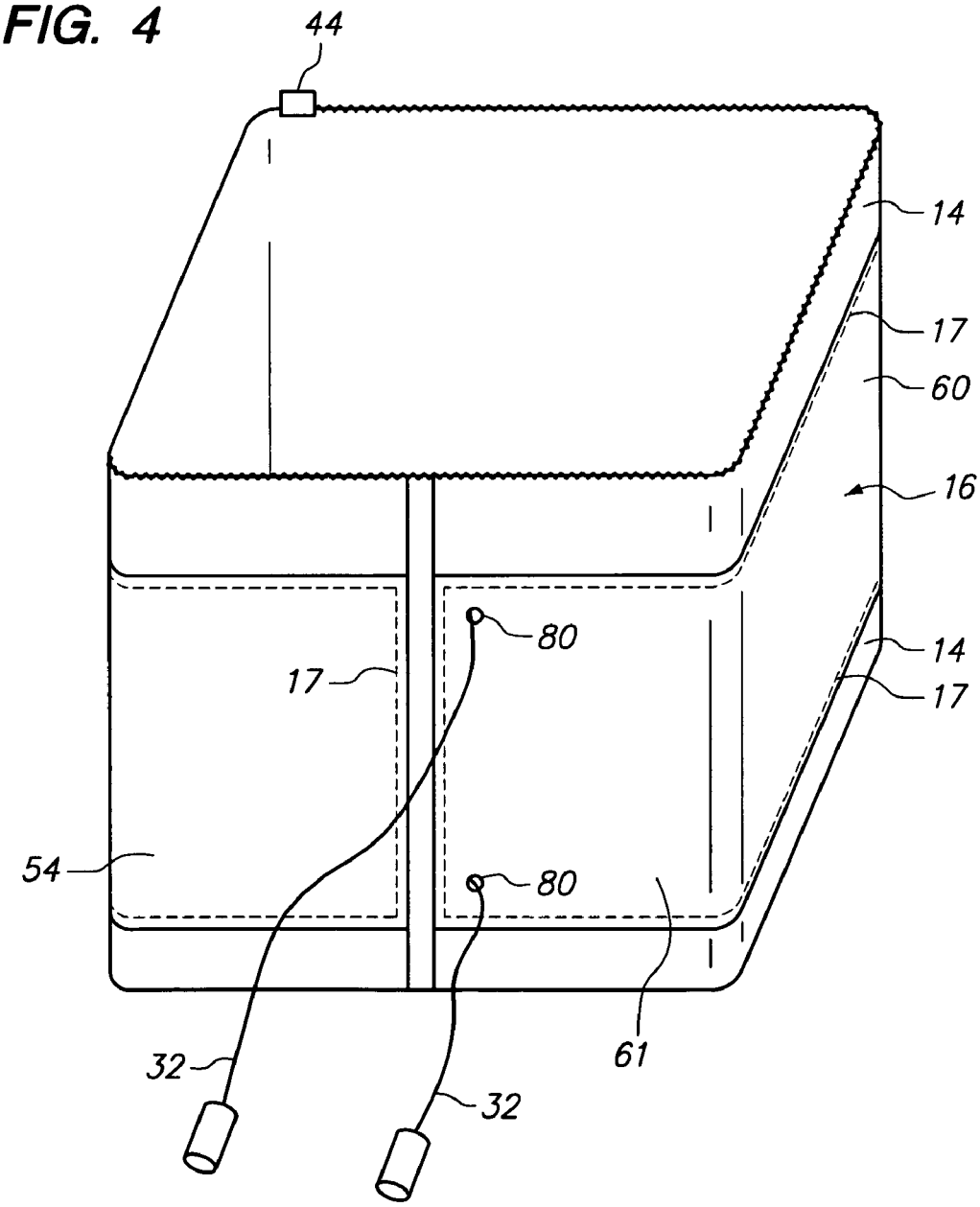
FIG. 4 is a schematic depicting a side view of an exemplary heating component.

Referring to FIGS. 1 and 4, in an exemplary embodiment secondary liner 14 serves as an attachment site for heater 16. Additionally, secondary liner 14 comprises teeth 42 and slider 44 such that secondary liner 14 can be attached to primary liner 12 by a zipping mechanism. Secondary liner 14 preferably comprises nylon.

Heater 16, which, in an exemplary embodiment, is disposed between secondary liner 14 and reflector 18, is thin, flexible, produces uniform temperatures throughout multi-layered carrier 10, has a high fatigue life, and can be mass-produced at an economical cost as contrasted with conventional heaters utilized in carriers. In addition, heater 16 can be operated at voltages ranging from about 12 volts to about 120 volts from either alternating current ("AC") or direct current ("DC") power supplies.

Figure 5:
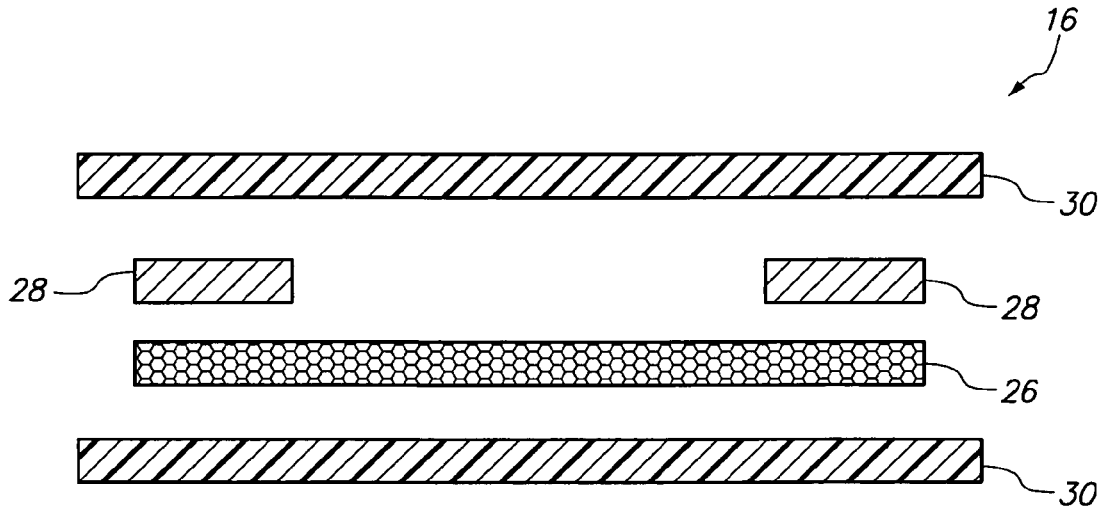
FIG. 5 is a schematic depicting a cross-sectional view of an exemplary heater.
Figure 6:
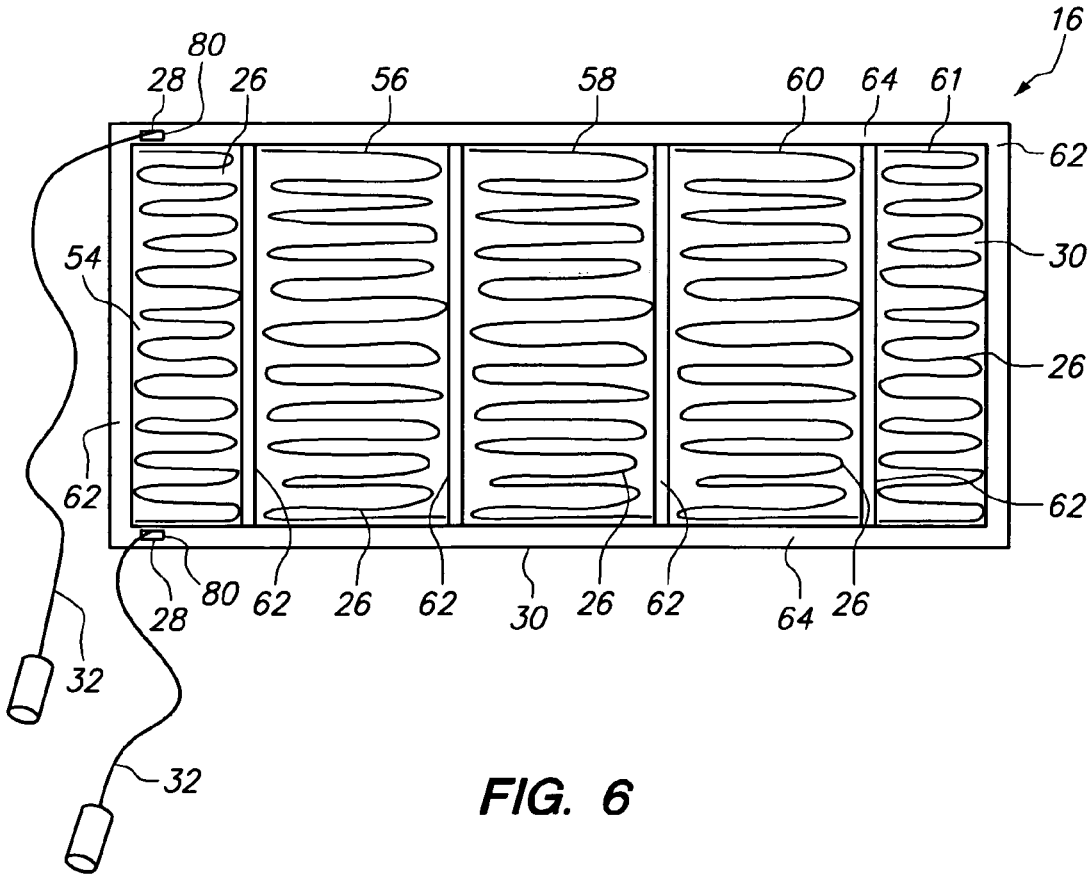
FIG. 6 is a schematic depicting an elevational view of a surface of an exemplary heater.

An exemplary heater and process for making the heater is described in U.S. Pat. No. 6,483,087 to Gardner et al., which is incorporated herein in its entirety. Referring to FIGS. 4-6, in the present invention, heater 16 comprises a conductive fabric layer 26, two bus bars 28 positioned at opposing edges of conductive fabric layer 26 sandwiched between two outer thermoplastic layers 30.

Conductive fabric layer 26 can be made from various materials, which are known in the art, and comprises electrically conductive fibers. In a preferred embodiment, conductive fabric layer 26 comprises electrically conductive fibers, and more preferred carbon fibers, in particular, nickel-coated carbon fibers. In this embodiment, the conductive fibers are chopped fibers and are converted into a non-woven conductive fabric using papermaking techniques. An organic binder is used to hold the fibers together in conductive fabric layer 26. The thickness, density, fiber, coating and predominant fiber direction of the fabric all determine the final resistivity of heater 16. Depending on the size of heater 16 and power output required, the appropriate length of conductive fabric layer 26 can be cut from a supply roll or an entire roll can be used for mass producing the heater elements.

In a preferred embodiment of the invention, the electrically conductive fabric layer is consolidated. A consolidated conductive fabric layer results from the consolidating step during the laminating process. Consolidation is a process by which thermoplastic layers 30 of heater 16 are brought to a gelling state under pressure during bonding of heater 16 and to a predetermined thickness. This causes the electrically conductive fibers of conductive fabric 26 to be brought into intimate contact with one another through the laminating process.

In an exemplary method of forming the heater, the carbon filaments are manufactured from a polymer fiber under high temperature and pressure within an inert environment. The fibers can be coated with a metal, such as nickel, brass, silver or other suitable metal or a combination thereof, by one of several processes, tailoring the temperature coefficient of resistance (the rate at which the electrical resistance of a medium changes as a result of a change in temperature) and resistivity of the final fabric. Fibers are combined into a row and chopped to a desired length between about 3 millimeters and 12 millimeters or longer. Fiber length is a major factor in determining conductive fabric layer 26's resistance, flexibility, structural conformity, and heat uniformity.

Thermoplastic films 30 for use in heater 16 can be of various types and are commercially available. In a preferred embodiment, the thermoplastic films 30 are polyetherimide (Ultem®, Westlake Plastics, Inc., Pa.), polyetheretherketone (Victrex®, Westlake Plastics, Inc. Pa.), polyamide (Kapton®, E. I. Dupont de Nemours, Del.), polyethersulfone, sulfone, polyvinylidine fluoride (Kynar®, PVDF, Westlake Plastics, Inc., Pa.), acetobutylstyrene (Cycolac, ABS, Westlake Plastics, Inc., Pa.), polyphenylene oxide (Noryl®, Westlake Plastics, Inc., Pa.), and the like.

Heater 16 is preferably attached to electrical leads 32 at bus bars 28. Bus bars 28 can be made of various materials such as copper, brass or silver foils. In a preferred embodiment, however, the bus bars are made of copper foils. In another embodiment, heater 16 further comprises a glass veil (not shown) disposed on the outer surfaces of the thermoplastic layers 30 for additional reinforcement.

Heater 16 can further comprises cuts (not shown) perpendicular to and through at least one of bus bars 28 in a zigzag pattern for creating a circuit and to increase the resistance of heater 16. In another embodiment, heater 16 further comprises an outer layer of thermoplastic or silicon rubber (not shown) for increasing the dielectric strength of heater 16.

An exemplary process for making heater 16 suitable for incorporation into the multi-layered carrier of the invention comprises disposing an electrically conductive fabric layer 26 onto the first layer of thermoplastic layer 30. Bus bars 28, preferably made of copper foil, are disposed on opposing edges of electrically conductive fabric layer 26 so that bus bars 28 are in contact with electrically conductive fabric layer 26 and are parallel to one another. Once bus bars 28 are in contact with conductive fabric layer 26, they can be attached to the conductive fabric layer 26 by piercing a hole through bus bars 28 and conductive fabric layer 26 using a piercing rivetor apparatus. The action of piercing causes the metal displaced to form a hole to curl and flatten under the conductive fabric layer 26, thereby securing bus bars 28 to conductive fabric layer 26. Thereafter, the second layer of thermoplastic layer 30 is disposed on electrically conductive fabric layer 26 and bus bars 28 to form a heater assembly. Once the heater layers are assembled, the heater assembly is heated at suitable temperatures to a set thickness to consolidate the conductive fabric layer 26 sandwiched in thermoplastic film layers 30, thereby forming a single sheet heater 16. After consolidation of the layers, and especially of conductive fabric layer 26, heater 16 is transferred to a cooling chamber to quench heater 16 at its maximum consolidation state. A glass fiber reinforcement layer can be disposed on the outer surfaces of the thermoplastic layers 30 prior to consolidation and depending on heater 16's output requirement.

While the process described above can be performed on a small scale to produce a number of small heaters using a hydraulic press, the process can be adapted for manufacturing heater elements and heaters in high volume using a roller laminating apparatus. In roller lamination, the heater element is produced in a single long sheet of indefinite length and width, which length and width are only limited by the length and width of the starting materials and machinery used. The heater element made through roller lamination can be stored in rolls, and heaters can be made from segments of the heater element as required. In this embodiment, the process comprises combining electrically conductive fabric layer 26 from a roll supply with two metal foil bus bars 28, wherein bus bars 28 are positioned parallel to one another at opposing edges of and contacting conductive fabric layer 26 in the direction of the roll. Bus bars 28 are secured to conductive fabric layer 26 by making a hole in conductive fabric layer 26 and bus bars 28 by piercing the components in a piercing rivetor apparatus as described above. Once bus bars 28 are secured to the conductive fabric layer 26, conductive fabric layer 26 containing bus bars 28 is drawn between two layers of thermoplastic films 30 forming a sandwich type structure assembly. The heater assembly sandwich is then fed through a pinch roller, which has been preheated at a predetermined temperature and set at a predetermined pressure to cause gelling of thermoplastic layers 30. The gelling of thermoplastic layers 30 causes some of the thermoplastic to flow through conductive fabric layer 26, fusing the films and consolidating the conductive fibers into a single sheet heater element. Once consolidation occurs, the resultant single sheet fabric heater is drawn over a cooling chamber so that maximal consolidation of the layers is maintained. Individual heaters can be made by cutting a section from the heater sheet roll with a tooling die or a water jet cutter, attaching electrical leads by ultrasonic welding and laminating it once more with a layer of thermoplastic, thereby maintaining the gap cut by the die or water jet and providing a final dielectric layer.

During the manufacturing process, the heater is configured to fit the multi-layered carrier of the present invention. Referring to FIG. 6, in an exemplary embodiment, heater 16 comprises upper and lower thermoplastic layers 30 which each comprise vertical seals 62 and horizontal seals 64 to create segments 54, 56, 58, 60, and 61. One each of bus bars 28 is located and runs along the length of its respective horizontal seal 64. A conductive fabric layer 26 is disposed in each of segments 54, 56, 58, 60, and 61, and leads 32 are connected to respective bus bars 28, and emanate outwardly from vias 80. In this embodiment, vertical seals 62 assist in creating folds whereby heater 16 can be more easily fitted into multi-layered carrier 10. For example, referring to FIGS. 4 and 6, in an exemplary embodiment, each of segments 54, 56, 58, 60, and 61 may be disposed on separate lateral sides of secondary liner 14 such that segments 54 and 61 are opposite to segment 58 and segment 56 is opposite to segment 60. Heater 16 is preferably disposed such that each of vertical seals 62 are disposed along the edges connecting adjacent lateral sides of multi-layered carrier 10.

Again referring to FIGS. 1-3, in addition to heater 16, multi-layered carrier 10 further comprises reflector 18, which preferably comprises aluminized films or fabrics made of polyester, polyethylene, Mylar® sold by DuPont, urethane coated nylon, reflective laminates, non-woven polyolefins or polyvinylchloride, and the like, and combinations comprising at least one of the foregoing, wherein aluminized polyester is preferred. Reflector 18 reflects the heat generated from heater 16 to preserve the temperature in a cavity 34. It is noted that the reflector may be positioned as shown in the figures, or it may be positioned elsewhere between or among the layers of the carrier. Alternatively, the reflector may be completely dispensed with such as when a consumer's specifications require a lower temperature range than what is typical for the field of application.

Still referring to FIGS. 1-3, carrier 10 further comprises insulator 20. Insulator 20 preferably comprises compressed spun polyester, low-density polyester foam, Thinsulate® sold by 3M Company, cellular urethane alone or in combination with polystyrene, wherein compressed spun polyester, such as NU Foam® by Fairfield, is particularly preferred. Insulator 20 further preserves the temperature in cavity 34 by preventing the escape of heat generated by heater 16 through jacket 22.

Jacket 22 of carrier 10 may comprise canvas, nylon, vinyl, and the like, wherein a vinyl coated nylon is particularly preferred. An especially preferred vinyl coated nylon is ballistic nylon produced by DuPont, which is sold under the tradename Cordura®.

At least one of jacket 22, insulator 20, reflector 18, heater 16, secondary layer 14, and primary layer 12 forms a bottom side 66 of carrier 10. Additionally, referring to FIG. 1, jacket 22 comprises a top layer 23 that conceals heater 16, reflector 18, and insulator 20.

Figure 8:
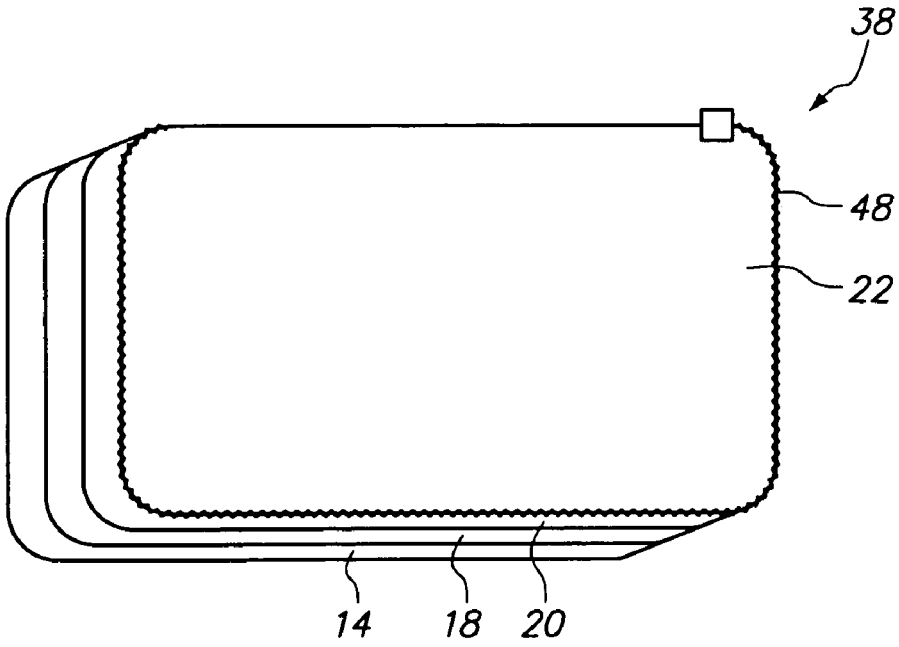
FIG. 8 is a schematic depicting an exemplary multi-layered cover.

Referring to FIGS. 1 and 8, in an exemplary embodiment, multi-layered carrier 10 further comprises a multi-layered cover 38 attached to top layer 23 of jacket 22 by means of an outer zipper 36. In an exemplary embodiment, multi-layered cover 38 comprises secondary liner 14, reflector 18, insulator 20, and jacket 22 as described previously herein.

The various components forming multi-layered carrier 10 may be assembled in a variety of ways. Referring to the figures, in an exemplary embodiment, insulator 20 is positioned between jacket 22 and reflector 18 preferably by sliding insulator 20 and reflector 18 into position. Heater 16 is attached to secondary liner 14 by wrapping heater 16 around secondary liner 14, and securing heater 16 thereto by fastening means, such as, stitches 17, to form heating component 40. Heating component 40 may be attached to top surface 23 of jacket 22 by stitching, for example. Primary liner 12 may be removably secured onto multi-layered carrier 10 by means of an inner zipper, wherein primary liner 12 comprises teeth 46 complimentary to teeth 42 on secondary liner 14. A slider 44 may be used to zip or unzip the inner zipper such that primary liner 12 may be attached or removed from multi-layered carrier 10.

Cover 38 comprises teeth 48 complimentary to teeth 50 to form outer zipper 36, wherein teeth 50 may be located on top surface 23 of jacket 22. A slider 52 slides over teeth 48 and 50 to zip or unzip cover 38, thereby closing or opening multi-layered carrier 10.

Electrical leads 32, which extend from vias 80 of heater 16, are electrically connected to a plug 70. Plug 70 exits carrier 10 via an eyelet 68 formed in jacket 22. Plug 70 is configured such that it can be plugged into either an AC or DC power supply, such as is found in the cigarette lighter of an automobile.

Referring to FIG. 1, multi-layered carrier 10 may further comprise carrying means whereby multi-layered carrier 10 can be easily conveyed. For example, multi-layered carrier 10 may comprise a shoulder strap 72 which straddles opposite sides of multi-layered carrier 10, and/or two handles 74, wherein each of handles 74 is located on opposite sides of multi-layered carrier 10. Additionally, multi-layered carrier 10 may comprise a pocket 76, into which plug 70, for example, can be easily stored.

Figure 7:
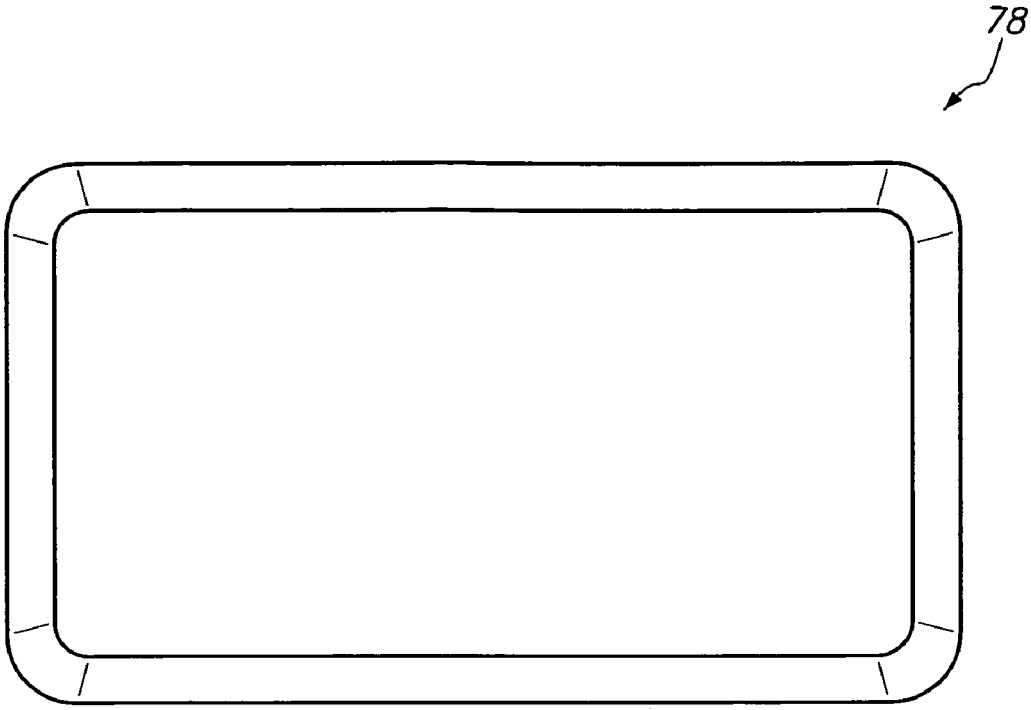
FIG. 7 is a schematic depicting an exemplary tray.

Referring to FIG. 7, multi-layered carrier 10 may further comprise a tray 78, onto which the perishable item(s) can be placed. An exemplary tray 78 provides a flat, hard surface onto which the perishable item(s) can be placed, thereby reducing the fall or spillage of the perishable item(s). Tray 78 may be positioned on the bottom floor of the carrier, i.e., on the primary layer. Tray 78 is removable from multi-layered carrier 10, thereby providing a convenient serving device to a consumer, wherein the consumer can also eat and/or drink directly from tray 78. An exemplary tray 78 comprises a conventional cafeteria-style serving tray.

Although the multi-layered carrier depicted in the Figures comprises a square shape, it is contemplated herein that the multi-layered carrier may comprise a wide variety of shapes and dimensions as ultimately directed by the use of the multi-layered carrier. Nevertheless, in an exemplary embodiment, the multi-layered carrier comprises a length of about 9 inches to about 24 inches, a height of about 9 to about 24 inches, and a width of about 9 to about 24 inches.

The multi-layered carrier disclosed herein is able to maintain the temperature of perishable items, particularly, those perishable items that are to be maintained at a federallydetermined bacteriological temperature safety zone prior to delivery. For example, the multi-layered carrier can maintain perishable items at a temperature of at least about 140 degrees Fahrenheit. The temperature can be maintained for as long as the heater remains plugged into an electrical power source, which is significantly better than the prior art multi-layered carriers, in which temperature can be maintained for only about 2 hours. Additionally, the multi-layered component can be manufactured at a cost significantly lower than electrically heated thermal multi-layered carriers of the prior art. The heater disclosed herein is malleable, such that it can be incorporated into a variety of shaped and dimensioned multi-layered carriers. Additionally, the heater distributes heat in an even manner, thereby increasing the efficiency of the multi-layered carrier.

What is claimed is:

1. A multi-layered carrier comprising:

a first layer having an exterior surface opposite to an interior surface, wherein the interior surface of the first layer envelops a cavity;

a jacket disposed around the exterior surface of the first layer;

a laminated fabric heater wrapped around and contiguous with the exterior surface of the first layer, wherein the heater comprises a consolidated electrically conductive fabric layer, a plurality of bus bars, a first thermoplastic layer, and a second thermoplastic layer, wherein the first and second thermoplastic layers sandwich the consolidated electrically conductive fabric layer and the plurality of bus bars to form a fused single sheet; and an insulator, wherein the jacket surrounds the insulator and the insulator surrounds the heater wherein the multi-layer carrier provides for the even distribution of heat throughout the cavity.

2. The multi-layered carrier of claim 1, further comprising electrical leads attached to the bus bars.

3. The multi-layered carrier of claim 2, further comprising a plug attached to the electrical leads, wherein the plug is further attachable to a motor vehicle's power supply.

4. The multi-layered carrier of claim 1, further comprising a reflector, wherein the reflector surrounds the heater and the insulator surrounds the reflector.

5. The multi-layered carrier of claim 4, further comprising a second layer, wherein the interior surface of the first layer surrounds the second layer.

6. The multi-layered carrier of claim 5, wherein the second layer comprises vinyl, and the first layer comprises nylon.

7. The multi-layered carrier of claim 1, further comprising a tray disposed within the cavity.

8. The multi-layered carrier of claim 1, wherein:

the exterior surface and the interior surface of the first layer are joined to form a plurality of lateral sides, wherein adjacent lateral sides of the plurality are connected to each other via edges; and the heater further comprises:

a first horizontal seal extending along a top outer edge of the heater;

a second horizontal seal extending along a bottom outer edge of the heater;

a plurality of vertical seals each extending from the first horizontal seal to the second horizontal seal, wherein the vertical seals divide the heater into distinct segments;

wherein each of the vertical seals is disposed on and folded over a respective edge of the first layer to ease placement of the heater around the first layer.

9. The multi-layered carrier of claim 8, wherein the insulator comprises at least one of compressed spun polyester, low-density polyester foam, and cellular urethane alone or in combination with polystyrene.

10. The multi-layered carrier of claim 9, further comprising a reflector, wherein the reflector surrounds the heater and the insulator surrounds the reflector, and further wherein the reflector comprises at least one of aluminized films and fabrics made of polyester, polyethylene, urethane coated nylon, non-woven polyolefins or polyvinylchloride.

11. A multi-layered carrier comprising:

a combination element comprising:

a first layer comprising lateral sides, wherein adjacent lateral sides are connected to each other via edges; and a heater for generating heat comprising:

a first horizontal seal extending along a lop outer edge of the heater;

a second horizontal seal extending along a bottom outer edge of the heater; and a plurality of vertical seals each extending from the first horizontal seal to the second horizontal seal, wherein the vertical seals divide the heater into distinct segments, wherein each segment comprises:

a consolidated electrically conductive fabric layer, a first thermoplastic layer, and a second thermoplastic layer, wherein the first and second thermoplastic layers sandwich the consolidated electrically conductive fabric layer;

wherein the first and second horizontal seals and the vertical seals comprise a thermoplastic;

wherein each of the vertical seals is disposed on and folded over a respective edge of the first layer such that the heater envelops and is contiguous with the lateral sides of the first layer, and further wherein the vertical seals ease fitting of the heater onto the lateral sides; and a plurality of layers surrounding at least one of the first layer and the heater, wherein the plurality of layers retains the heat generated by the heater.

12. The multi-layered carrier of claim 11, wherein the plurality of layers comprises an insulator.

13. The multi-layered carrier of claim 12, wherein the plurality of layers further comprises a reflector.

14. The multi-layered carrier of claim 12, wherein the combination element and the plurality of layers are arranged to create a cavity, and further comprising a fray disposed within the cavity.

15. The multi-layered carrier of claim 8, wherein the heater is secured to the first layer by fastening the first horizontal seam and the second horizontal seam to the exterior side of the first layer.

16. The multi-layered carrier of claim 15, wherein the heater is secured to the first layer by stitching the first horizontal seam and the second horizontal seam to the exterior side of the first layer.

* * * * *